US009884736B2

(12) United States Patent
Yamasaki

(10) Patent No.: US 9,884,736 B2
(45) Date of Patent: Feb. 6, 2018

(54) CONVEYING ROLLER, AND FEEDING UNIT AND IMAGE FORMING APPARATUS PROVIDED THEREWITH

(71) Applicant: KYOCERA Document Solutions Inc., Osaka (JP)

(72) Inventor: Shunsuke Yamasaki, Osaka (JP)

(73) Assignee: KYOCERA Document Solutions Inc., Osaka (JP)

( * ) Notice: Subject to any disclaimer, the term of this patent is extended or adjusted under 35 U.S.C. 154(b) by 0 days.

(21) Appl. No.: 15/363,678

(22) Filed: Nov. 29, 2016

(65) Prior Publication Data

US 2017/0153590 A1 Jun. 1, 2017

(30) Foreign Application Priority Data

Nov. 30, 2015 (JP) ..... 2015-232858

(51) Int. Cl.
*B65H 5/00* (2006.01)
*B65H 3/06* (2006.01)
(Continued)

(52) U.S. Cl.
CPC ..... *B65H 3/0638* (2013.01); *B65H 3/0607* (2013.01); *B65H 27/00* (2013.01); *G03G 15/6529* (2013.01); *B65H 2404/1374* (2013.01)

(58) Field of Classification Search
CPC B65H 3/0638; B65H 27/00; B65H 2404/123; B65H 2404/1231; B65H 2404/132; B65H 2404/1321; B65H 2404/134; B65H 2404/1343; B65H 2404/1345; B65H 2404/1374
See application file for complete search history.

(56) References Cited

U.S. PATENT DOCUMENTS 5,494,237 A * 2/1996 Summey, III ..... B65H 18/20 226/190
2006/0180985 A1* 8/2006 Lee ..... B65H 3/0638 271/109

(Continued)

FOREIGN PATENT DOCUMENTS

JP 2000136049 A * 5/2000 ..... B65H 5/021
JP 2000136049 A * 5/2000 ..... B65H 5/021
JP 2011-131951 A 7/2011

*Primary Examiner* — Prasad V Gokhale
(74) *Attorney, Agent, or Firm* — Stein IP, LLC

(57) ABSTRACT

A conveying roller has a rotary shaft portion, a roller supporting member, and a roller member. The rotary shaft portion is extendable/contractible. The roller supporting member has an interior space. The roller member is supported on the outer circumferential surface of the roller supporting member. The rotary shaft portion includes first and second shafts. The first shaft has one end part inserted into the interior space, and is movable axially relative to a first side surface. The first shaft has a regulating portion displaceable between a permitting position where the regulating portion permits the movement of the first shaft in the insertion direction relative to the roller supporting member without interfering with a rim of an opening and a restricting position where the regulating portion restricts the movement of the first shaft in the insertion direction relative to the roller supporting member by interfering with the rim.

8 Claims, 10 Drawing Sheets

(51) Int. Cl.
*B65H 27/00* (2006.01)
*G03G 15/00* (2006.01)

(56) References Cited

U.S. PATENT DOCUMENTS

2008/0101842 A1* 5/2008 Takahashi ..... B41J 13/076
400/617
2009/0267293 A1* 10/2009 Watanabe ..... B65H 3/0638
271/264
2015/0034456 A1* 2/2015 Koshimura ..... B65H 3/0638
198/789

* cited by examiner

CONVEYING ROLLER, AND FEEDING UNIT AND IMAGE FORMING APPARATUS PROVIDED THEREWITH

INCORPORATION BY REFERENCE

This application is based upon and claims the benefit of priority from the corresponding Japanese Patent Application No. 2015-232858 filed on Nov. 30, 2015, the entire contents of which are incorporated herein by reference.

BACKGROUND

The present disclosure relates to a conveying roller that conveys a sheet, and to a feeding unit and an image forming apparatus provided with such a conveying roller.

In conventional image forming apparatuses such as copiers and printers, many conveying rollers are provided as a means for conveying sheets. A conveying roller is composed of, for example, a roller member for conveying a sheet by rotating while in contact with the sheet, and a rotary shaft to which the roller member is fitted. The surface of the roller member wears due to friction occurring between it and a sheet or the like. Thus, the conveying roller is preferably configured to be replaceable.

As a solution, an image forming apparatus is known in which a conveying roller is configured to be replaceable. This image forming apparatus includes a conveying roller which is extendable/contractible in the axial direction, and a supporting portion which supports the conveying roller on opposite sides in the axial direction. The conveying roller is composed of a roller (roller member) for conveying a sheet by rotating while in contact with the sheet, a main shaft (roller supporting member) to which the roller is fitted, a sub-shaft (first shaft) fitted to be slidable in the axial direction relative to the main shaft, and an elastic member arranged inside the main shaft for biasing the sub-shaft outward in the axial direction.

In this image forming apparatus, moving the sub-shaft in the insertion direction relative to the main shaft causes the conveying roller to contract in the axial direction, and this makes it possible to easily mount/dismount a conveying roller relative to a supporting portion.

SUMMARY

According to one aspect of the present disclosure, a conveying roller is mountably/dismountably supported on a mounting portion. The conveying roller includes a rotary shaft portion, a roller supporting member, and a roller member. The rotary shaft portion is extendable/contractible. The roller supporting member is in a cylindrical shape including an outer circumferential surface with an interior space. The roller member is supported on the outer circumferential surface, and conveys a sheet by rotating while in contact with the sheet. The roller supporting member includes a first side surface including an opening through which the interior space is open, and a second side surface arranged opposite to the first side surface. The rotary shaft portion includes a first shaft arranged at the first side surface, and a second shaft arranged at the second side surface. The first shaft includes one end part thereof inserted into the interior space through the opening of the first side surface, and is movable in the axial direction relative to the first side surface. The first shaft includes a regulating portion which is arranged on the outer circumferential surface thereof and which is displaceable between a permitting position in which the regulating portion permits, as the first shaft moves in the insertion direction relative to the roller supporting member, the movement of the first shaft in the insertion direction without interfering with a rim of the opening and a restricting position in which the regulating portion restricts the movement of the first shaft in the insertion direction relative to the roller supporting member by interfering with the rim.

Further features and advantages of the present disclosure will become apparent from the description of embodiments given below.

DETAILED DESCRIPTION

Figure 1:
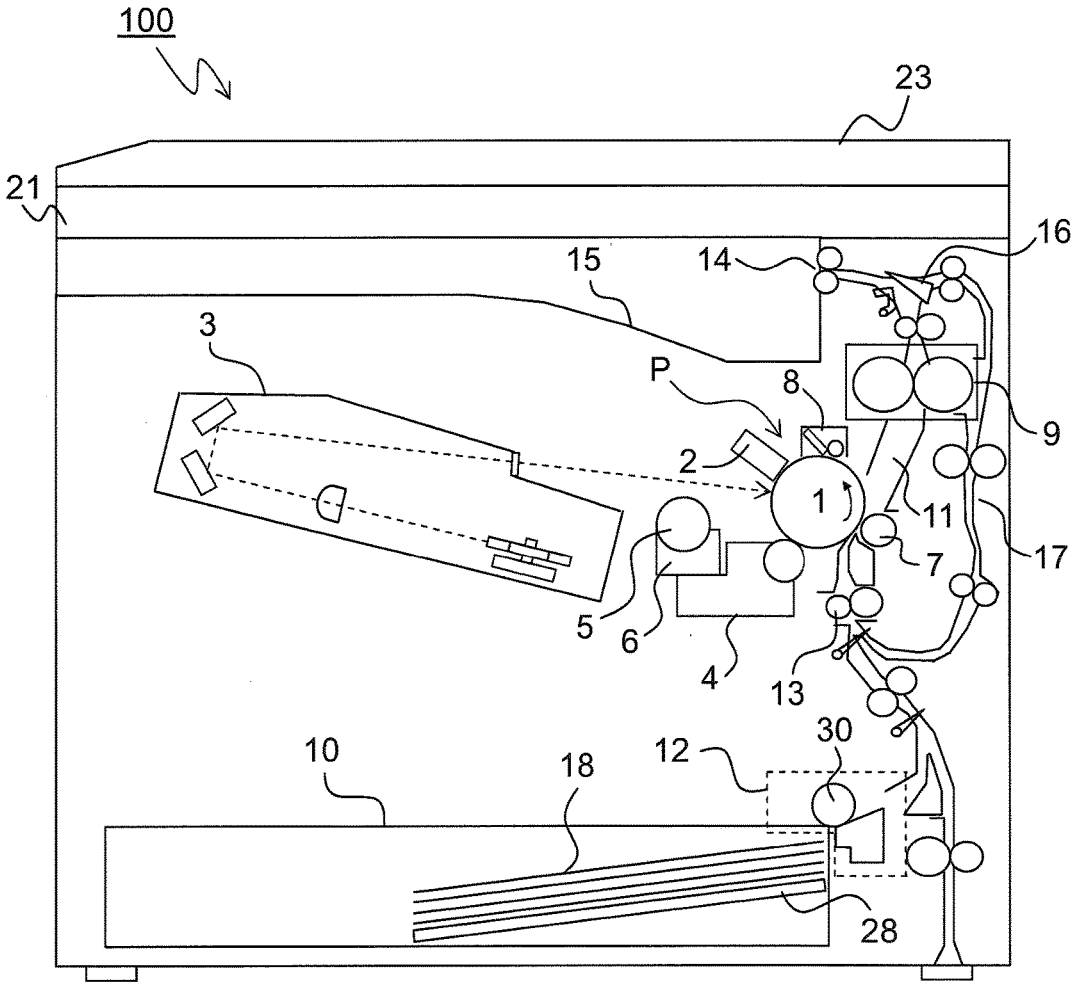
FIG. 1 is a diagram showing an image forming apparatus incorporating a sheet feeding roller according to one embodiment of the present disclosure.

Hereinafter, an embodiment of the present disclosure will be described with reference to the accompanying drawings. As shown in FIG. 1, inside the main body of an image forming apparatus 100, an image forming portion P is arranged for forming a monochrome image through the processes of electrostatic charging, exposure to light, image development, and image transfer. Here, FIG. 1 shows a monochrome multifunction peripheral as the image forming apparatus 100.

In the image forming portion P, there are arranged, along the rotation direction of a photosensitive drum 1 (the counter-clockwise direction in FIG. 1), a charging device 2, an exposure unit 3, a developing device 4, a transfer roller 7, a cleaning device 8, and a destaticizer (unillustrated). In the image forming portion P, an image forming process is performed with respect to the photosensitive drum 1 while it is rotated in the counter-clockwise direction in FIG. 1.

The photosensitive drum 1 is, for example, an aluminum drum of which the surface is laid with a photosensitive layer comprising an organic photosensitive substance (OPC). The surface of the photosensitive drum 1 is electrostatically charged by the charging device 2. When the surface is irradiated with a laser beam from the exposure unit 3, which will be described later, an electrostatic latent image with attenuated electrostatic charge is formed.

The developing device 4 forms a toner image by attaching toner to the electrostatic latent image on the photosensitive drum 1. Toner is fed to the developing device 4 from a toner container 5 via an intermediate hopper 6.

The transfer roller 7 transfers, without disturbing, the toner image formed on the surface of the photosensitive drum 1 to a sheet conveyed through a sheet conveyance passage 11. The cleaning device 8 has a cleaning roller, a cleaning blade, or the like that makes line contact with the photosensitive drum 1 in its longitudinal direction. After the toner image is transferred to the sheet, the cleaning device 8 removes toner left unused on the surface of the photosensitive drum 1.

An image reading portion 21 is composed of a scanning optical system incorporating a scanner lamp for illuminating a document during copying and a mirror for changing the optical path of light reflected from the document, a converging lens for converging the light reflected from the document to form an image, a CCD (charge-coupled device) sensor for converting image light of the formed image into an electric signal, etc. (none of these is illustrated). The image reading portion 21 reads a document image and converts it into image data.

In a lower part of the main body of the image forming apparatus 100, there is arranged a sheet feed cassette 10 for storing sheets 18. In the sheet feed cassette 10, there is arranged a sheet placement plate 28 on which sheets 18 are stacked. The sheet placement plate 28 is configured to be movable up and down on the downstream side in the sheet feed direction (the right side in FIG. 1) with a swing shaft (unillustrated) serving as a fulcrum on the upstream side in the sheet feed direction.

Toward the image forming portion P where a toner image has been formed as described above, a sheet 18 is fed out from the sheet feed cassette 10 by a sheet feeding unit (feeding unit) 12, and is conveyed via a sheet conveyance passage 11 and a registration roller pair 13, with predetermined timing, to the image forming portion P. Then, in the image forming portion P, the toner image on the surface of the photosensitive drum 1 is transferred to the sheet 18 by the transfer roller 7. The sheet 18 having the toner image transferred to it is separated from the photosensitive drum 1, and is conveyed to a fixing device 9, where the toner image is heated and pressed so as to be thereby fixed to the sheet 18.

The sheet 18 having passed through the fixing device 9 is distributed between different conveyance directions by a branching portion 16 which branches into a plurality of directions. When an image is formed only on one side of the sheet 18, the sheet 18 is discharged, as it is, onto a discharge tray 15 by a discharge roller pair 14.

On the other hand, when images are formed on both sides of the sheet 18, the sheet 18 having passed through the fixing device 9 is first conveyed in the direction of the discharge roller pair 14. After the tail end of the sheet 18 passes through the branching portion 16, the discharge roller pair 14 is rotated in the reverse direction, and the conveyance direction of the branching portion 16 is switched so that the sheet 18 is, starting with its tail end, distributed into a reverse conveyance passage 17, and the sheet 18 is, with the image side reversed, conveyed once again to the registration roller pair 13. Then, the next image formed on the photosensitive drum 1 is transferred by the transfer roller 7 to the side of the sheet 18 on which no image has yet been formed. The sheet 18 is then conveyed to the fixing device 9, where the toner image is fixed, and is then discharged onto the discharge tray 15.

Figure 2:
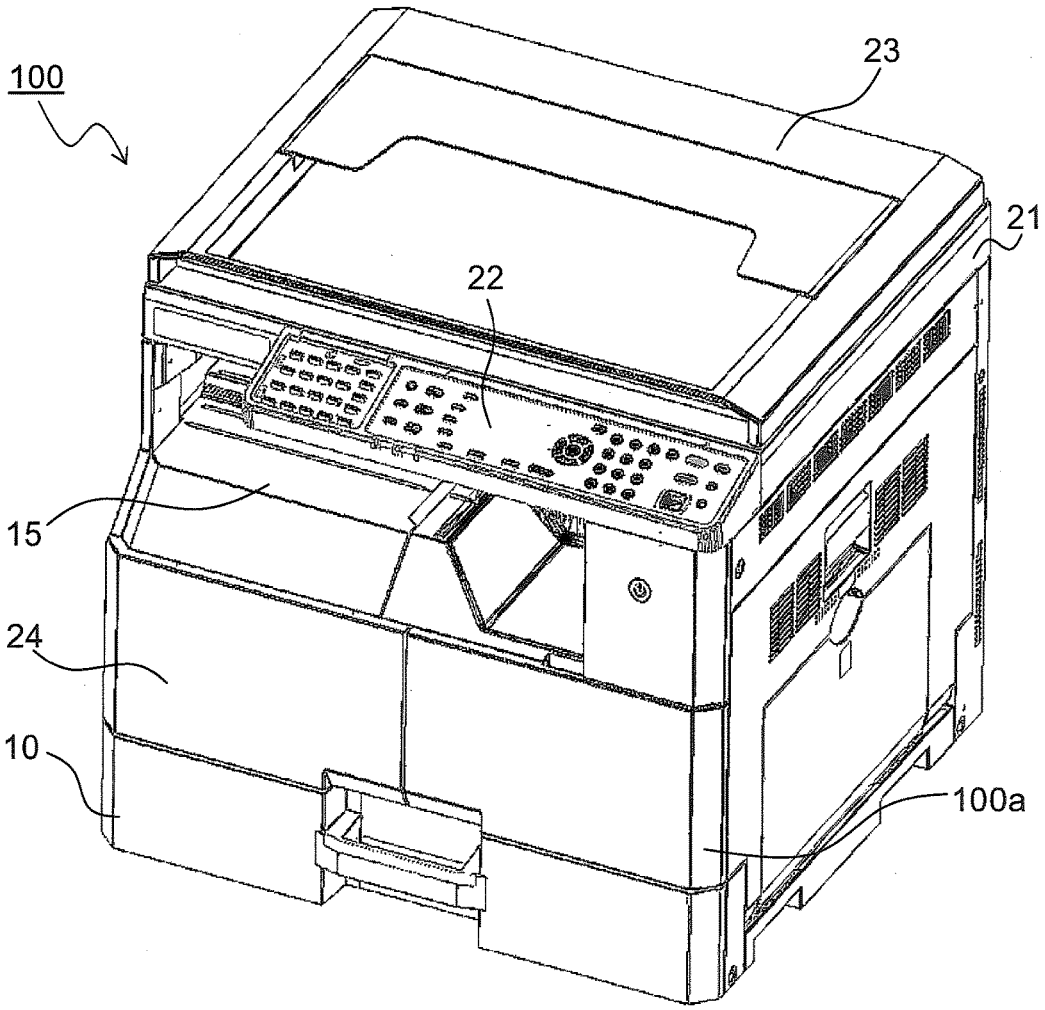
FIG. 2 is an exterior perspective view of the image forming apparatus incorporating the sheet feeding roller according to one embodiment of the present disclosure.

As shown in FIG. 2, on the top surface of the image reading portion 21, there are arranged a document placement stage (unillustrated) fitted with a transparent glass plate (contact glass), and an operation panel 22 protruding to the front face side of the main body of the image forming apparatus 100 (in the front direction in FIG. 1). Moreover, over the top surface of the image reading portion 21, a platen (document presser) 23 is openably/closably supported that presses and thereby holds a document placed on the document placement stage.

On the front face side of a housing 100*a*, a front cover 24 is openably/closably arranged. Opening the front cover 24 allows the maintenance and exchange of the members inside the housing 100*a* to be performed.

Figure 3:
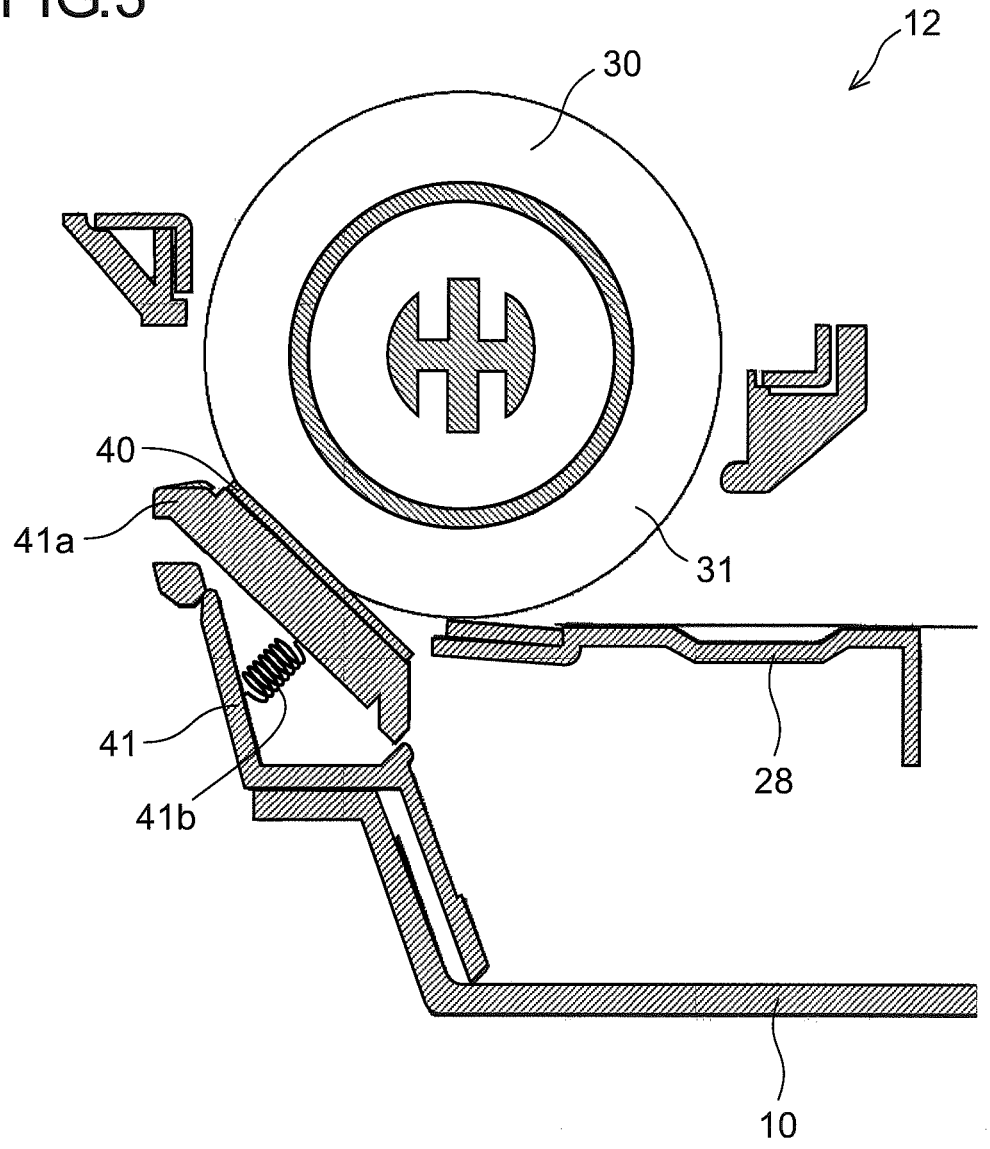
FIG. 3 is a sectional view showing a structure around the sheet feeding roller according to one embodiment of the present disclosure.
Figure 4:
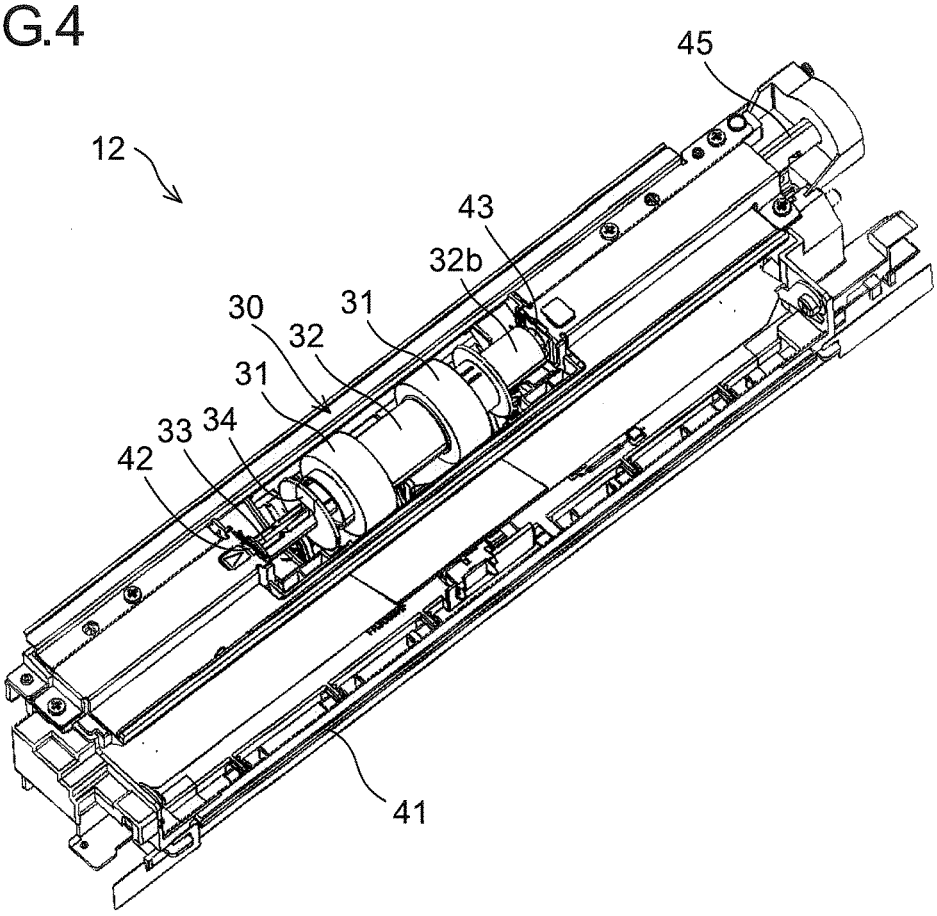
FIG. 4 is a perspective view showing a structure of a sheet feeding unit including the sheet feeding roller according to one embodiment of the present disclosure.
Figure 5:
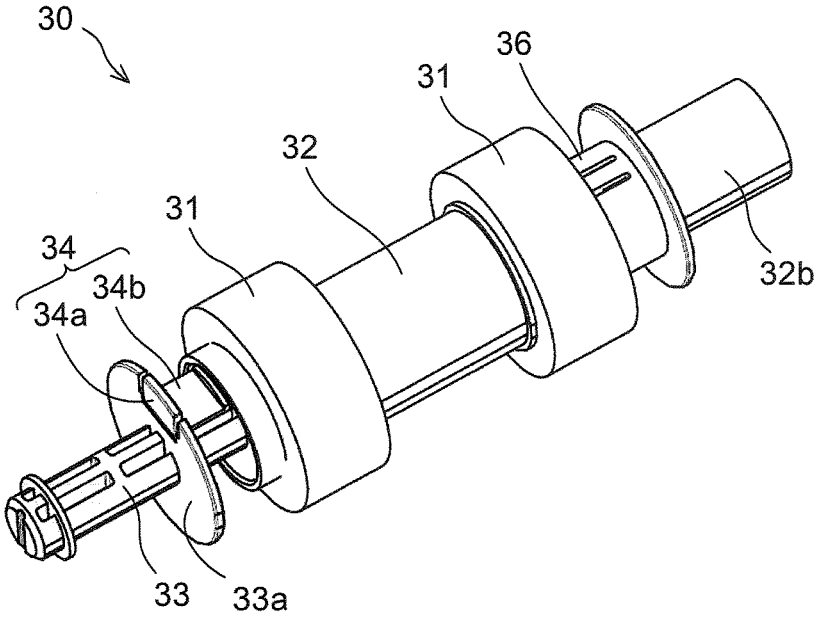
FIG. 5 is a perspective view showing a structure of the sheet feeding roller according to one embodiment of the present disclosure, showing a state where the sheet feeding roller is extended.

As shown in FIGS. 3 and 4, the sheet feeding unit 12 is fitted to the main body of the image forming apparatus 100 in the vicinity of the downstream-side end part (the left end part in FIG. 3) of the sheet feed cassette 10 in the sheet feed direction. FIGS. 3 and 4 show a state as seen from the rear side with respect to the plane of FIG. 1. The sheet feed cassette 10 is mountable/dismountable in the direction perpendicular to the plane of FIG. 3.

The sheet feeding unit 12 includes a sheet feeding roller (conveying roller) 30 for feeding a sheet 18 out from the sheet feed cassette 10 by making pressed contact with the sheet 18, a separation pad (separation member) 40 for separating the sheet 18 by holding it at a nip with the sheet feeding roller 30, and a case 41 for holding these.

The separation pad 40 is, so as to face the sheet feeding roller 30, fixed to an inclined surface portion 41*a* of the case 41. The inclined surface portion 41*a* is biased toward the sheet feeding roller 30 by a compression spring 41*b*. The separation pad 40 is formed of such a material that generates a comparatively large friction force with a sheet 18. Thus, as a result of the sheet feeding roller 30 rotating while in contact with a bundle of sheets 18 stacked on the sheet placement plate 28, only the topmost sheet 18 is separated between the sheet feeding roller 30 and the separation pad 40 to be fed out.

The sheet feeding roller 30 has an extendable/contractible rotary shaft portion (a first shaft 33 and a second shaft 32*b*, which will be described later), and is mountably/dismountably supported on a mounting portion (a bearing member 42 and a coupling 43, which will be described later). Specifically, of the sheet feeding roller 30, one end part (the left end part in FIG. 4, the left end part of the first shaft 33 as will be described later) is rotatably supported on the bearing member 42 (see FIG. 6); the other end part (the right end part in FIG. 4, the second shaft 32*b* of a roller supporting member 32 as will be described later) is connected to the coupling 43 (see FIG. 6). The coupling 43 is formed at one end of a drive shaft 45 that extends up to an end part (the right end part in FIG. 4) in the opposite direction from the sheet feeding roller 30 and that transmits a rotation driving force. An end part (the right end part in FIG. 4) of the drive shaft 45 in the direction opposite from the coupling 43 is fitted with an input gear (unillustrated) to which a rotation driving force is fed.

Figure 6:
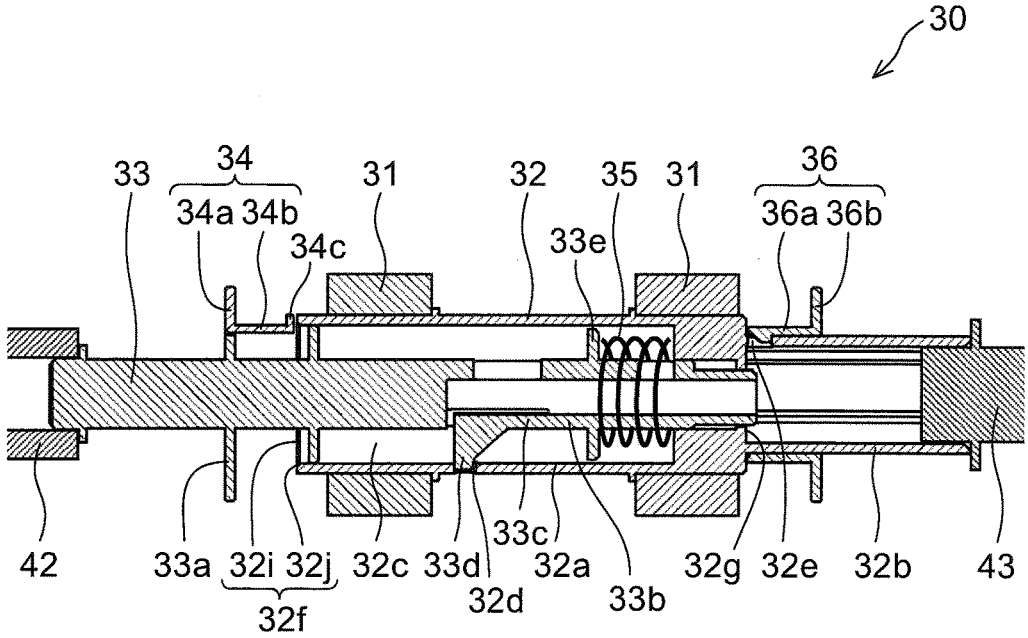
FIG. 6 is a sectional view showing a structure around the sheet feeding roller according to one embodiment of the present disclosure, showing the state where the feeding roller is extended.

As shown in FIGS. 5 to 8, the sheet feeding roller 30 is configured to be extendable/contractible in its axial direction (the longitudinal direction, the left/right direction in FIG. 6). The sheet feeding roller 30 is composed of a pair of cylindrical roller members 31, a cylindrical roller supporting member 32, a first shaft 33, a regulating portion 34, a compression spring (second biasing member) 35, and a knob portion 36. The rotary shaft portion of the sheet feeding roller 30 is composed of a first shaft 33 and a second shaft 32*b*, of which the latter will be described later. The roller supporting member 32, the first shaft 33, the regulating portion 34, and the knob portion 36 are made of resin.

The pair of roller members 31 is, for example, made of rubber, and conveys a sheet 18 by rotating while in contact with it.

The roller supporting member 32 has a cylindrical body 32*a* around the outer circumferential surface of which the roller members 31 are fitted, a second shaft 32*b* which extends from the body 32*a* in the axial direction and to which the coupling 43 is fixed. As a rotation driving force is fed in from the coupling 43, the roller supporting member 32 rotates together with the roller member 31.

Figure 9:
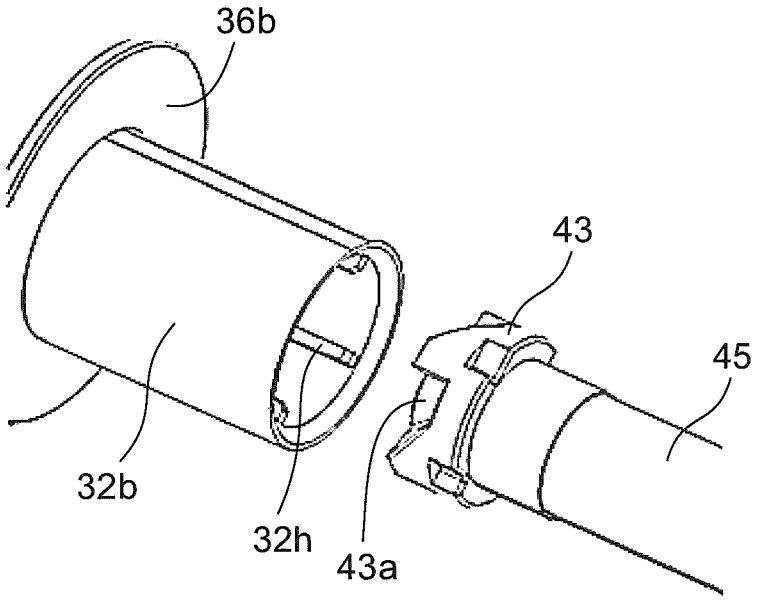
FIG. 9 is a perspective view showing a structure of a part where a second shaft of the sheet feeding roller according to one embodiment of the present disclosure and a coupling are connected to each other.

The body 32*a* has an interior space 32*c*, a first side surface 32*f* having an opening 32*i* through which the interior space 32*c* is open, and a second side surface 32*g* which is arranged opposite the first side surface 32*f* and which is provided with the second shaft 32*b*. The interior space 32*c* has one end part of the first shaft 33 inserted into it, and is formed so as to extend in the axial direction. The first side surface 32*f* has an opening 32*i* and a rim 32*j*. In the body 32*a*, there is formed an engagement hole 32*d* engaged with an engaging portion 33*b*, which will be described later, of the first shaft 33. In the second shaft 32*b*, there is formed an engagement hole 32*e* engaged with an engaging portion 36*c*, which will be described later, of the knob portion 36. As shown in FIG. 9, on the inner circumferential surface of the second shaft 32*b*, there are formed a plurality of (here three) engaging protrusions 32*h* protruding inward in the radial direction (the direction orthogonal to the axial direction) so as to engage with a plurality of engaging concavities 43*a* formed in the coupling 43. Thus, the rotation driving force of the coupling 43 is transmitted to the second shaft 32*b*.

The first shaft 33 is arranged about the same axis as the roller supporting member 32 so as to be slidable in the axial direction relative to the roller supporting member 32. The first shaft 33 has a first flange 33*a*, which protrudes radially outward from the outer circumferential surface of the first shaft 33, is arranged opposite the first side surface 32*f*, and is fitted with the regulating portion 34, and an engaging portion (locking portion) 33*b*, which is elastically deformable in the radial direction. The engaging portion 33*b* has an arm 33*c* having formed in it cuts at opposite sides extending in the axial direction, and a claw 33*d* protruding from a tip end of the arm 33*c* in a radial direction to engage with the engagement hole 32*d* of the body 32*a*. The engaging portion 33*b* is formed into a so-called snap-fit structure. The engaging portion 33*b* allows the movement of the first shaft 33 in the insertion direction (the rightward direction) from the state in FIG. 6, but restricts the movement in the draw-out direction (the leftward direction).

Figure 7:
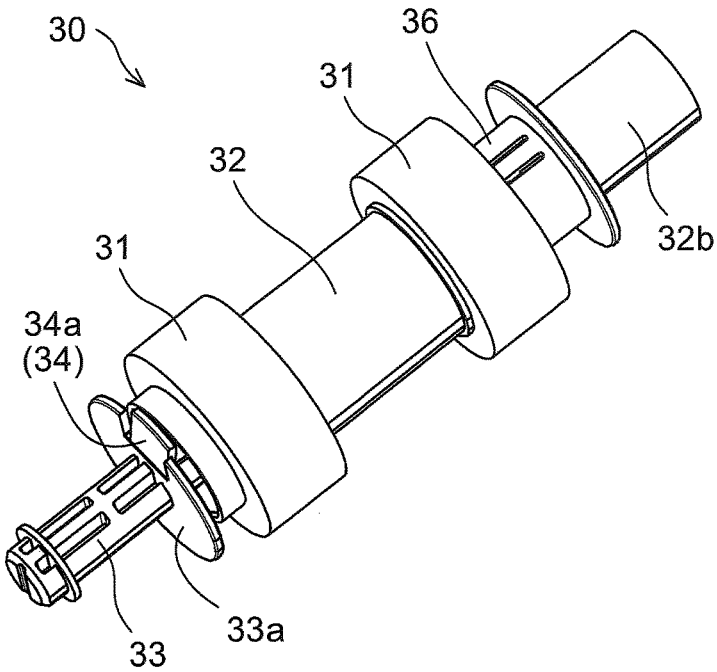
FIG. 7 is a perspective view showing a structure of the sheet feeding roller according to one embodiment of the present disclosure, showing a state where the sheet feeding roller is contracted.
Figure 10:
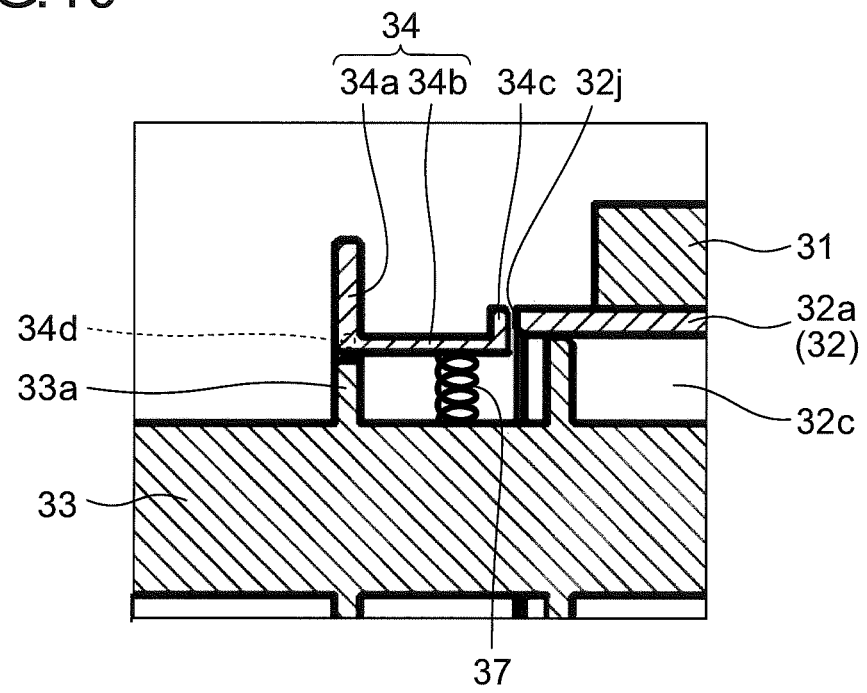
FIG. 10 is a sectional view showing a structure around a regulating portion of the sheet feeding roller according to one embodiment of the present disclosure, showing a state where a lever of the regulating portion is not pressed in the axial direction.

As shown in FIGS. 7 and 10, the regulating portion 34 is swingably fitted in a cut part formed by cutting out a part of the first flange 33*a* of the first shaft 33. The regulating portion 34 has a lever 34*a* which is a plate-form piece extending parallel to the first flange 33*a*, and a contact piece 34*b* which is formed integrally with the lever 34*a* and which extends in the axial direction to make contact with the rim 32*j* (the left end in FIG. 10) of the body 32*a* of the roller supporting member 32, and is formed substantially in an L-shape. In an inner part of the lever 34*a* in a radial direction, a fulcrum 34*d* is arranged protruding from opposite side edges in the circumferential direction. In an inner side surface of the cut part of the first flange 33*a*, a shaft hole (unillustrated) is formed for swingably supporting the fulcrum 34*d*. In a first side surface 32*f*-side end part (the right end part in FIG. 10) of the contact piece 34*b*, a protruding portion 34*c* is formed protruding in a radial direction.

Figure 8:
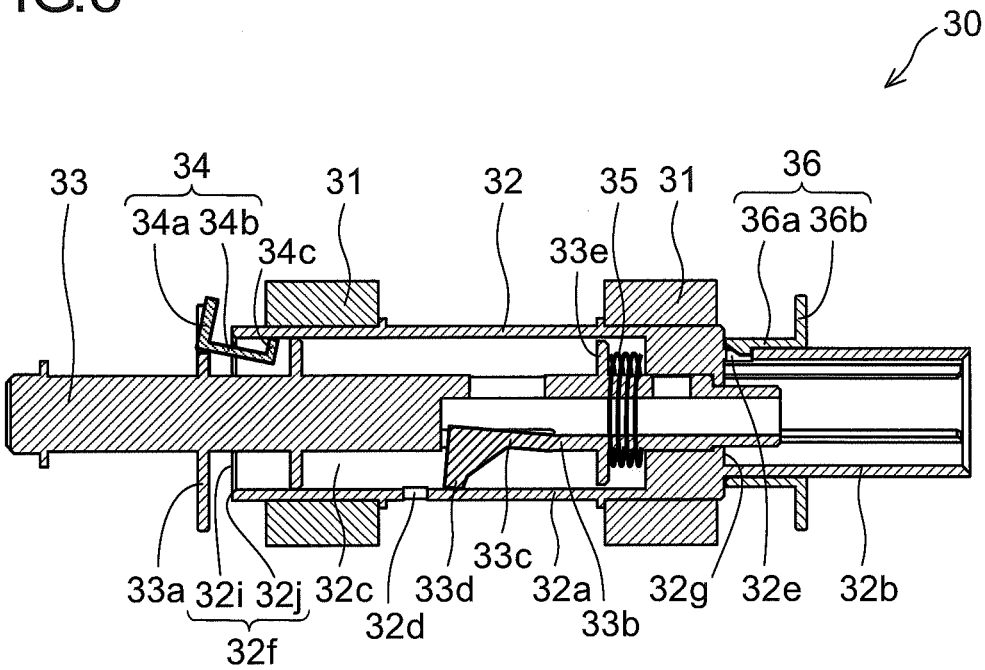
FIG. 8 is a sectional view showing a structure around the sheet feeding roller according to one embodiment of the present disclosure, showing the state where the sheet feeding roller is contracted.
Figure 11:
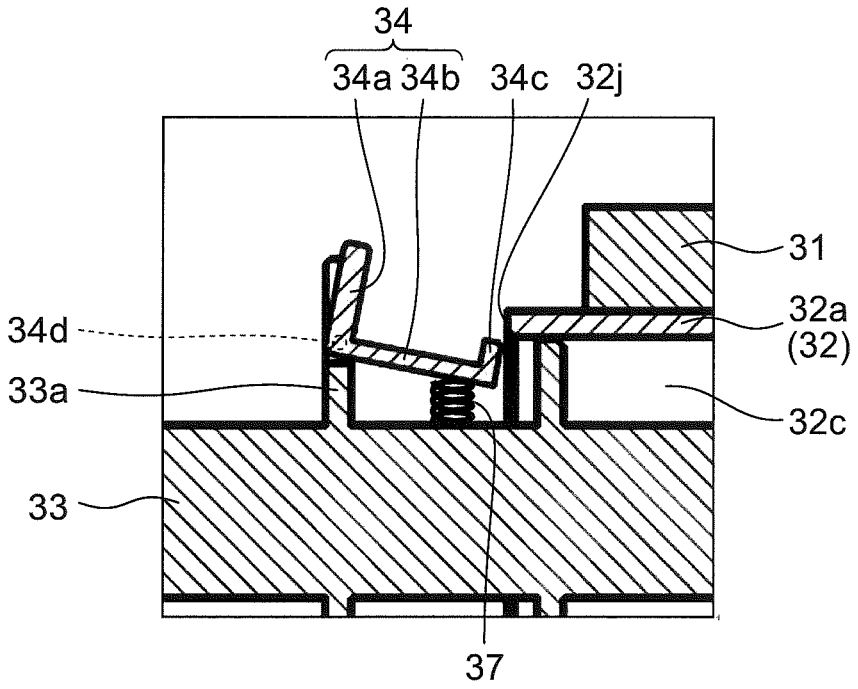
FIG. 11 is a sectional view showing a structure around the regulating portion of the sheet feeding roller according to one embodiment of the present disclosure, showing a state where the lever of the regulating portion is pressed in the axial direction.

When arranged in a restricting position (the position in FIG. 10) where the protruding portion 34*c* makes contact (interferes) with the rim 32*j* of the opening 32*i* of the roller supporting member 32, the regulating portion 34 restricts the movement of the first shaft 33 in the insertion direction (the rightward direction in FIG. 10) relative to the roller supporting member 32. On the other hand, as a result of the lever 34*a* being pressed in the axial direction (the direction of the first side surface 32*f*), the regulating portion 34 is displaced (swings) in a radial direction from the restricting position while maintaining its L-shape as shown in FIG. 11 to be arranged in a permitting position (the position in FIG. 11) so that the contact (interference) between the regulating portion 34 and the rim 32*j* of the roller supporting member 32 is released. In this state, as shown in FIGS. 7 and 8, the first shaft 33 can move up to a contracted position (the position in FIGS. 7 and 8) with respect to the interior space 32*c* of the roller supporting member 32, thereby reducing the length of the sheet feeding roller 30 in the axial direction.

Figure 12:
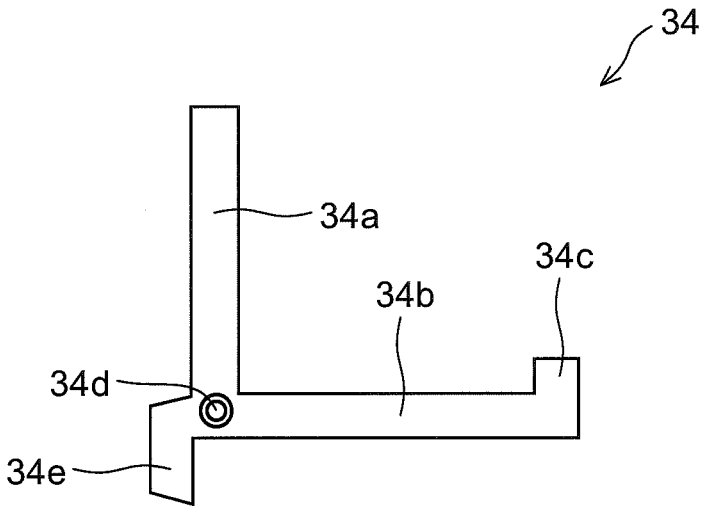
FIG. 12 is a diagram showing an example of a structure in which a rotation regulating portion is provided in the regulating portion of the sheet feeding roller according to one embodiment of the present disclosure.
Figure 13:
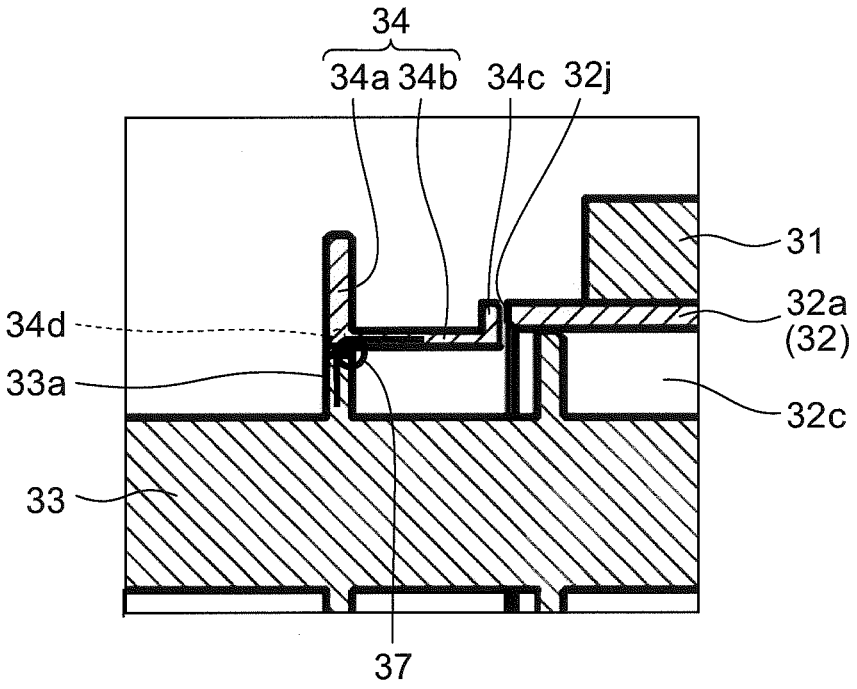
FIG. 13 is a sectional view showing a structure around the regulating portion of the sheet feeding roller according to one embodiment of the present disclosure, showing an example in which a torsion spring is used as a biasing member.

The sheet feeding roller 30 is provided with a first biasing member 37 for biasing the regulating portion 34 in the direction of the restricting position when the regulating portion 34 is arranged in the permitting position shown in FIG. 11. The first biasing member 37 holds the regulating portion 34 in the restricting position (the position in FIG. 10)

in a state where the regulating portion 34 is not pressed in the axial direction. For example, there may be provided a rotation regulating portion 34*e* (see FIG. 12) for regulating the rotation of the regulating portion 34 such that the first biasing member 37 extends no farther than in the state in FIG. 10. The first biasing member 37 may be a coil spring arranged between the contact piece 34*b* and the outer circumferential surface of the first shaft 33 as shown in FIGS. 10 and 11, or may be a torsion spring arranged around the swing fulcrum of the regulating portion 34 as shown in FIG. 13. This, however, is not meant as any limitation.

As shown in FIG. 6, the compression spring 35 is arranged in the interior space 32*c* of the roller supporting member 32. A tip end part of the first shaft 33 in the insertion direction (the rightward direction in FIG. 6) serves as a spring supporting portion for supporting the compression spring 35. Around the spring supporting portion, a flange portion 33*e* is formed for receiving the biasing force of the compression spring 35. The first shaft 33 is biased in the draw-out direction (the leftward direction in FIG. 6) by the compression spring 35. Thus, after the sheet feeding roller 30 is compressed in the axial direction from the state shown in FIGS. 5 and 6, when the compression force is released, the sheet feeding roller 30 extends so that the engaging portion 33*b* of the first shaft 33 engages with the engaging hole 32*d* of the body 32*a*, returning to the state shown in FIGS. 5 and 6.

Figure 14:
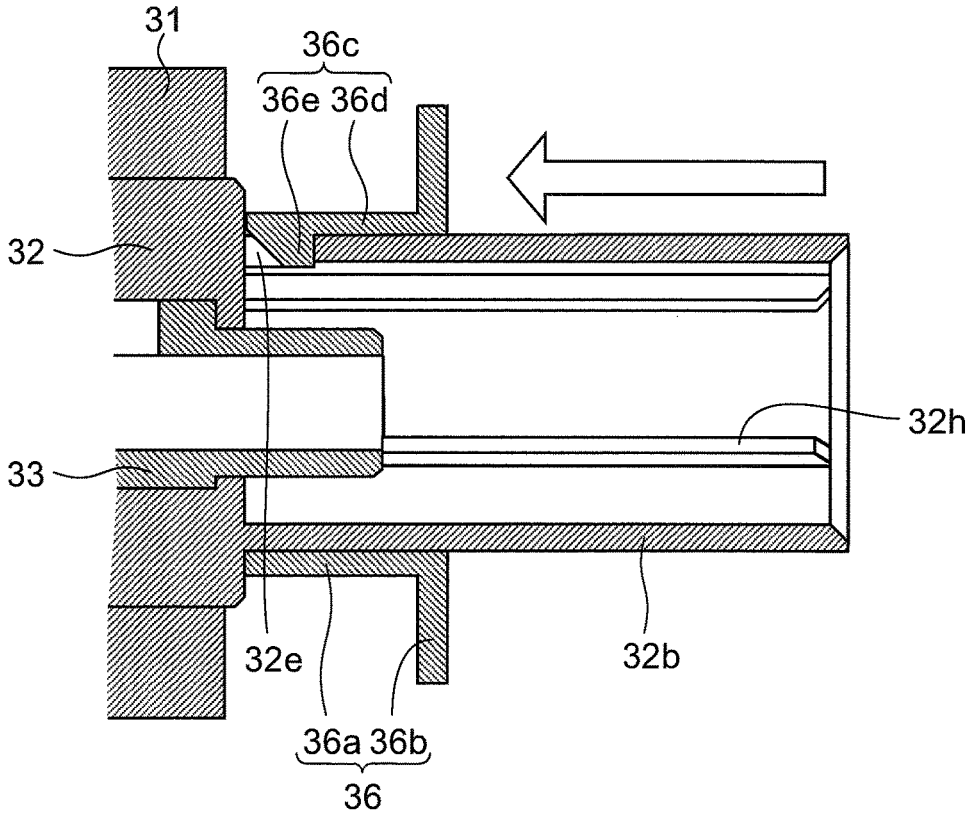
FIG. 14 is a sectional view showing a structure around a knob portion of the sheet feeding roller according to one embodiment of the present disclosure.
Figure 15:
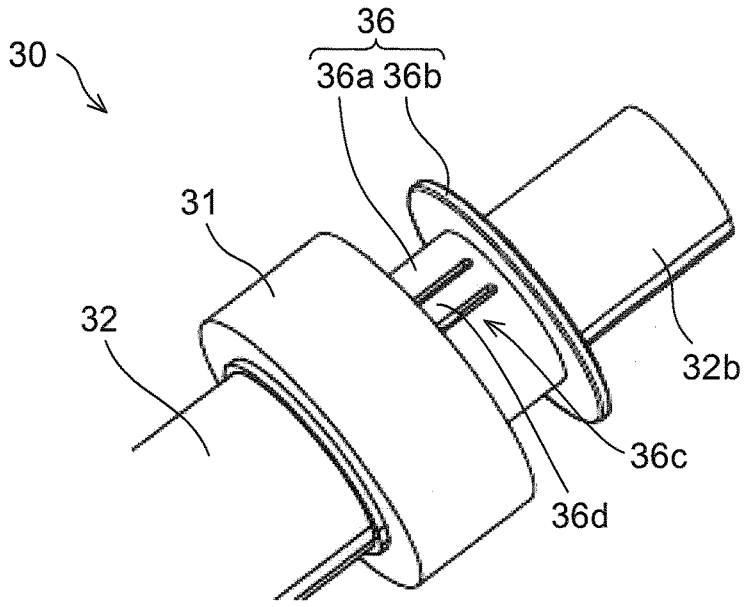
FIG. 15 is a perspective view showing a structure around the knob portion of the sheet feeding roller according to one embodiment of the present disclosure.

The knob portion 36 is fixed to the outer circumferential surface of the second shaft 32*b* of the roller supporting member 32. The knob portion 36 has a cylindrical portion 36*a* and a second flange 36*b* which protrudes radially outward from the cylindrical portion 36*a* and which is arranged opposite the second side surface 32*g*. On the side surface of the cylindrical portion 36*a*, as shown in FIGS. 14 and 15, the engaging portion 36*c* is formed which engages with the engagement hole 32*e* of the second shaft 32*b*. The engaging portion 36*c* has an arm 36*d* having formed in it cuts at opposite sides extending in the axial direction, and a claw 36*e* protruding radially inward from a tip end of the arm 36*d* to engage with the engagement hole 32*e* of the second shaft 32*b*. The engaging portion 36*c* is formed into a so-called snap-fit structure. The knob portion 36 is slid along the outer circumferential surface of the second shaft 32*b* from the right side in FIG. 14, and thereby the engaging portion 36*c* engages with the engagement hole 32*e* so that the knob portion 36 is fixed to the second shaft 32*b*. An operator can, by hooking fingers on the second flange 36*b* of the knob portion 36 and on the regulating portion 34, easily release the engagement of the regulating portion 34 with the roller supporting member 32 and easily shorten the sheet feeding roller 30 in the axial direction.

In this embodiment, as described above, the regulating portion 34 is provided for restricting the movement of the first shaft 33 in the insertion direction relative to the roller supporting member 32. Thus, during jam handing or the like, when a sheet 18 is stuck in a part of the sheet feeding roller 30, even when the sheet 18 is pulled such that a force is applied in the axial direction (the direction orthogonal to the sheet conveyance direction), the regulating portion 34 can restrict the movement of the first shaft 33 in the insertion direction relative to the roller supporting member 32. This prevents the sheet feeding roller 30 from contracting in the axial direction and thereby disengaging from the bearing member 42 and the coupling 43, and it is thus possible to suppress falling-off of the sheet feeding roller 30.

To replace the sheet feeding roller 30, the regulating portion 34 is displaceable to the permitting position to release the contact of the regulating portion 34 with the rim 32*j* of the roller supporting member 32. Thus, the first shaft 33 can be moved in the insertion direction relative to the roller supporting member 32, and thereby the sheet feeding roller 30 can be contracted in the axial direction. Thus, the sheet feeding roller 30 can be easily mounted on and dismounted from the bearing member 42 and the coupling 43, and thus the sheet feeding roller 30 can be easily replaced.

As described above, the first biasing member 37 is provided for biasing the regulating portion 34 in the direction of the restricting position when the regulating portion 34 is arranged in the permitting position. This allows the contact piece 34*b* to more reliably make contact with the rim 32*j* of the roller supporting member 32 with the sheet feeding roller 30 fitted to the bearing member 42 and the coupling 43.

As described above, the regulating portion 34 has a lever 34*a* extending in a radial direction, and a contact piece 34*b* extending in the axial direction to make contact with the rim 32*j* of the roller supporting member 32. Thus, by pressing the lever 34*a* in the axial direction, it is possible to displace the contact piece 34*b* in the radial direction and thus to easily release the contact of the contact piece 34*b* with the rim 32*j* of the roller supporting member 32.

As described above, on the roller supporting member 32-side end part of the contact piece 34*b*, the protruding portion 34*c* is formed protruding in a radial direction. This allows the roller supporting member 32-side end part of the contact piece 34*b* to reliably make contact with the rim 32*j* of the roller supporting member 32.

As described above, by providing the engaging portion 33*b* for permitting the movement of the first shaft 33 in the insertion direction and restricting the movement in the draw-out direction ascribable to the compression spring 35, it is possible to easily configure the sheet feeding roller 30 to be extendable/contractible while preventing the first shaft 33 from falling off from the second shaft 32 with respect to a single sheet feeding roller 30.

As described above, the sheet feeding roller 30, in particular, used in the sheet feeding unit 12 wears easily and needs to be replaced frequently, and thus it is particularly effective to apply the present disclosure to the sheet feeding roller 30 of the sheet feeding unit 12.

It should be understood that the embodiments disclosed herein are in every aspect illustrative and not restrictive. The scope of the present disclosure is defined not by the description of embodiments given above but by the appended claims, and encompasses many modifications and variations made in the sense and scope equivalent to those of the claims.

For example, although an example has been dealt with in which the present disclosure is applied to a monochrome copier, this is not meant as any limitation. Needless to say, the present disclosure is applicable to various image forming apparatuses provided with a conveying roller for conveying a sheet, examples including, color copiers, monochrome printers, color printers, digital multifunction peripherals, facsimile machines, etc.

Figure 16:
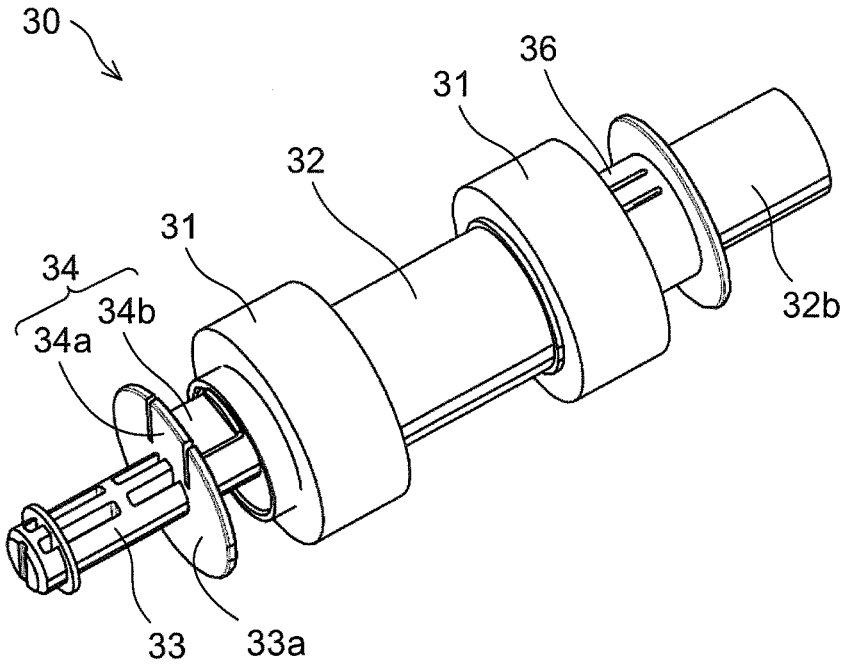
FIG. 16 is a perspective view showing a structure of a sheet feeding roller according to a modified example of the present disclosure.
Figure 17:
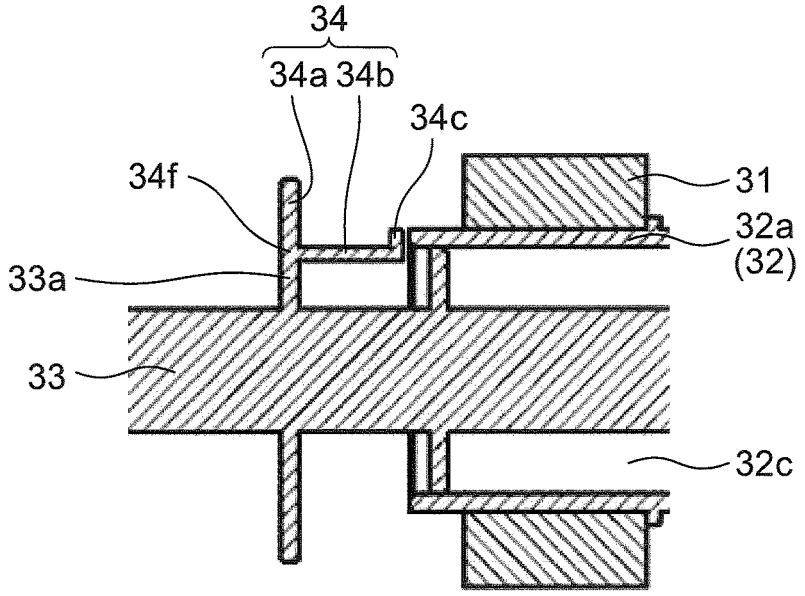
FIG. 17 is a sectional view showing a structure around a regulating portion of the sheet feeding roller according to the modified example of the present disclosure.

Although the above-described embodiment has dealt with an example where the regulating portion 34 is formed separately from the first shaft 33, it is also possible, for example, like the sheet feeding roller 30 according to a modified example shown in FIGS. 16 and 17, to form the lever 34*a* of the regulating portion 34 as a plate-form piece that is formed by cutting the outer circumferential surface of the first flange 33*a* of the first shaft 33 from two places, apart from each other across an interval, toward the first shaft 33 and that is elastically deformable in the axial direction (the direction of the first side surface 32*f*) about a base end part (an inner part in the radial direction) 34*f* connected to the first flange 33*a*. With this configuration, it is possible to eliminate the need for the first biasing member 37, and thus to reduce the number of components. Even with no first biasing member 37, the regulating portion 34 is arranged in the restricting position with the sheet feeding roller 30 fitted to the bearing member 42 and the coupling 43 (with the regulating portion 34 not pressed in the axial direction); this allows the contact piece 34*b* to make contact with the rim 32*j* of the roller supporting member 32.

Although the above-described embodiment has dealt with an example where the present disclosure is applied to a sheet feeding roller 30 that feeds out sheets 18 stored in the sheet feed cassette 10, this is in no way meant to limit the present disclosure. For example, the present disclosure may be applied to a sheet feeding roller that feeds out sheets stacked on a manual tray.

What is claimed is:

1. A conveying roller mountably and dismountably supported on a mounting portion, the conveying roller comprising:

a rotary shaft portion which is extendable and contractible;

a roller supporting member in a cylindrical shape including an outer circumferential surface with an interior space; and a roller member supported on the outer circumferential surface, the roller member conveying a sheet by rotating while in contact with the sheet, wherein the roller supporting member includes a first side surface including an opening through which the interior space is open, and a second side surface arranged opposite to the first side surface, the rotary shaft portion includes a first shaft arranged at the first side surface, and a second shaft arranged at the second side surface, the first shaft includes one end part thereof inserted into the interior space through the opening of the first side surface, and is movable in an axial direction relative to the first side surface, the first shaft includes a regulating portion which is arranged on an outer circumferential surface thereof and which is displaceable between a permitting position in which the regulating portion permits, as the first shaft moves in an insertion direction relative to the roller supporting member, movement of the first shaft in the insertion direction without interfering with a rim of the opening and a restricting position in which the regulating portion restricts the movement of the first shaft in the insertion direction relative to the roller supporting member by interfering with the rim, the first shaft includes a first flange which is provided on the outer circumferential surface of the first shaft and arranged opposite to the first side surface, the regulating portion includes a lever which constitutes a part of the first flange and which is provided on the first flange so as to be swingable toward the first side surface, and a contact piece which extends toward the rim of the opening from the lever and which makes contact with the rim in the restricting position, and the regulating portion is displaceable to the permitting position from the restricting position by swinging the lever to the first side surface.

2. The conveying roller of claim 1, wherein the lever is a plate-form piece fitted in a cut part formed by cutting out a part of the first flange, and includes a fulcrum which protrudes from opposite side edges of the lever and which is swingably supported on the first flange, and the conveying roller further comprises a first biasing member configured to bias the regulating portion to the restricting position from the permitting position so as to swing about the fulcrum.

3. The conveying roller of claim 1, wherein the lever is a plate-form piece formed by cutting an outer circumferential surface of the first flange from two places, apart from each other across an interval, toward the first shaft, and is swingable by elastically deforming in the direction of the first side surface about a base end part of the lever connected to the first flange.

4. The conveying roller of claim 1, wherein in a first side surface-side end part of the contact piece, a protruding portion, which protrudes in a radial direction orthogonal to the axial direction, is formed.

5. The conveying roller of claim 1, wherein a knob portion, which has a second flange arranged opposite the second side surface, is arranged on an outer circumferential surface of the second shaft.

6. The conveying roller of claim 1, further comprising:

a second biasing member configured to bias the first shaft in a draw-out direction; and a locking portion configured to permit the movement of the first shaft in the insertion direction while restricting the movement of the first shaft in the draw-out direction caused by the second biasing member.

7. A feeding unit comprising:

the conveying roller of claim 1;

the mounting portion on which the conveying roller is mountably or dismountably fitted; and a separation member configured to separate the sheet by holding the sheet at a nip with the conveying roller.

8. An image forming apparatus comprising:

the feeding unit of claim 7; and an image forming portion configured to form an image on a sheet fed out by the feeding unit.

* * * * *